United States Patent [19]

Tanikawa

[11] 4,014,542

[45] Mar. 29, 1977

[54] BAT USED IN BASEBALL

[76] Inventor: Yukio Tanikawa, No. 7203, Fukumitsumachi, Nishitonamigun, Toyama, Japan

[22] Filed: Mar. 14, 1974

[21] Appl. No.: 451,377

[30] Foreign Application Priority Data

Mar. 22, 1973 Japan ..... 48-32952

[52] U.S. Cl. ..... 273/72 R

[51] Int. Cl.[2] ..... A63B 59/06

[58] Field of Search ..... 273/67 R, 67 A, 72 R, 273/72 A, 73 F, 73 K, 80 R, 80 B, 82 R, 82 A, DIG. 6, DIG. 7, DIG. 8; 280/11.13 L

[56] References Cited

UNITED STATES PATENTS

| | | | |
|---|---|---|---|
| 716,541 | 12/1902 | Hillerich | 273/72 R |
| 805,132 | 11/1905 | Gubbins | 273/72 R |
| 2,064,435 | 12/1936 | Loeffler | 273/82 A X |
| 2,822,175 | 2/1958 | Redmond | 273/DIG. 7 |
| 3,015,327 | 1/1962 | Lightcap | 273/73 F X |
| 3,025,062 | 3/1962 | Duffin | 273/72 R X |
| 3,138,380 | 6/1964 | Satchell et al. | 273/82 A |
| 3,336,426 | 8/1967 | Boggs | 273/73 F UX |
| 3,353,258 | 11/1967 | Barton et al. | 273/72 R X |
| 3,353,826 | 11/1967 | Traverse | 273/72 R X |
| 3,367,656 | 2/1968 | Medney | 273/82 R |
| 3,478,134 | 11/1969 | Gruss et al. | 273/72 R X |
| 3,635,483 | 1/1972 | Barriball et al. | 273/73 F UX |
| 3,727,295 | 4/1973 | Gildemeister | 273/72 A X |
| 3,813,098 | 5/1974 | Fischer et al. | 273/72 R |

FOREIGN PATENTS OR APPLICATIONS

| | | | |
|---|---|---|---|
| 241,018 | 2/1960 | Australia | 273/DIG. 7 |
| 277,125 | 6/1965 | Australia | 273/82 A |

*Primary Examiner*—Richard J. Apley
*Attorney, Agent, or Firm*—Wenderoth, Lind & Ponack

[57] ABSTRACT

This invention relates to a bat of urethane foam used in baseball, which has a metal tube of duralumin at the barrel portion. The metal tube has many apertures therethrough, which are filled with urethane foam to fit the metal tube to the barrel portion because of the expansive quality of the urethane foam. The bat also has an outer layer of a glass fiber cloth which prevents a batter's hands and arms from becoming numb due to the shock caused by batting the ball and transmitted to him through the bat, and also prevents any broken part of the bat from scattering when the bat is broken. The outer layer, moreover, makes the bat sturdy. It is further possible to provide projections on the outer layer to eliminate the possibility of fouling and tipping.

6 Claims, 4 Drawing Figures

BAT USED IN BASEBALL

BRIEF SUMMARY OF THE INVENTION

This invention relates to bat used in baseball and a method of producing the bat.

a. The baseball bat of this invention, having a metal tube of suitable quality for batting a ball arranged at the batting or barrel portion of a main member, can lengthen the flight of a ball at the time of batting, and because the metal tube and the main member are covered with a cloth of glass fiber or other chemical fiber, the bat also can prevent the batter from becoming numb from the shock caused by batting the ball which is and transmitted to him through the bat by absorbing this shock in the cloth. Moreover, the bat is sturdy.

b. According to the method of the invention, since the metal tube is set and fixed around the barrel portion of the main member, it is easy to operate and when urethane foam or other synthetic resin material is adopted for the main member, it is possible to fix the metal tube securely to the main member by using a metal tube with many apertures and filling these apertures with the same material as in the main member. Besides this, since the metal tube and the main member are covered with a cloth of glass fiber or other chemical fiber or wound with the strings of these fibers to form the outer layer, a very tough bat will be obtainable and the projections formed on the upper layer will help to eliminate fouls and tips.

DETAILED DESCRIPTION

The present invention relates to a baseball bat.

It is an object of the present invention to provide a bat used in baseball which can lengthen the flight of a ball when properly hit.

Another object of the present invention is to provide a bat which can prevent a batter's hands and arms from becoming numb due to the shock caused by batting the ball and transmited to him through the bat.

A further object of the present invention is to provide a bat which is sturdy and is easy to produce.

A still further object of the present invention is to produce a baseball bats which will help to eliminate fouling and tipping.

Figure 1:
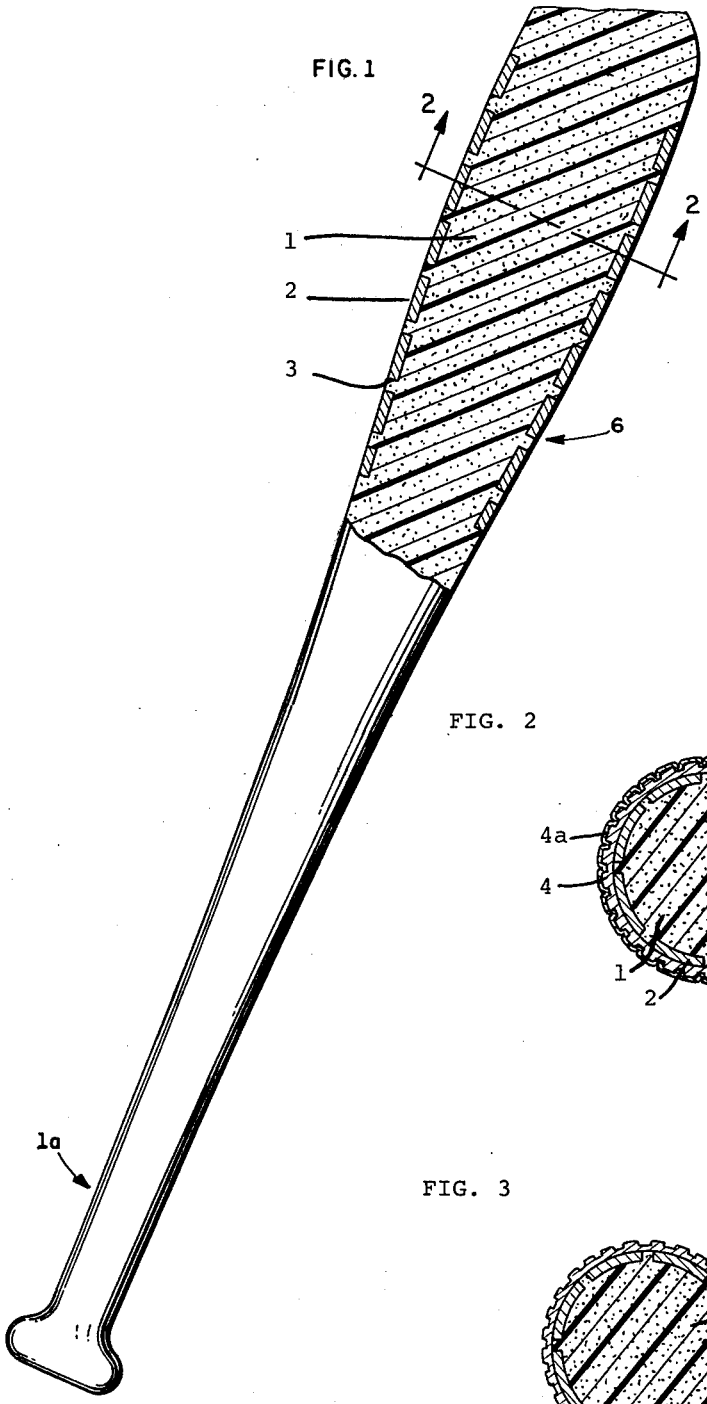
FIG. 1 is a partial section view showing one principal part of a baseball bat embodying the present invention.
Figure 2:
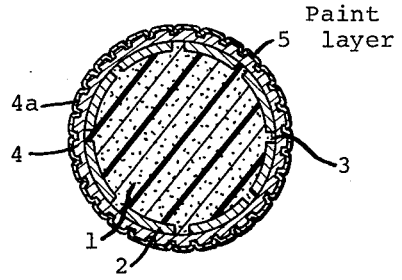
FIG. 2 is a transverse section view along the line 2—2 of FIG. 1 showing the construction of the invention.
Figure 3:
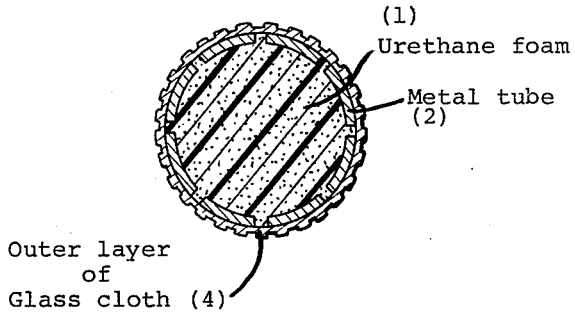
FIG. 3 is another embodiment thereof.
Figure 4:
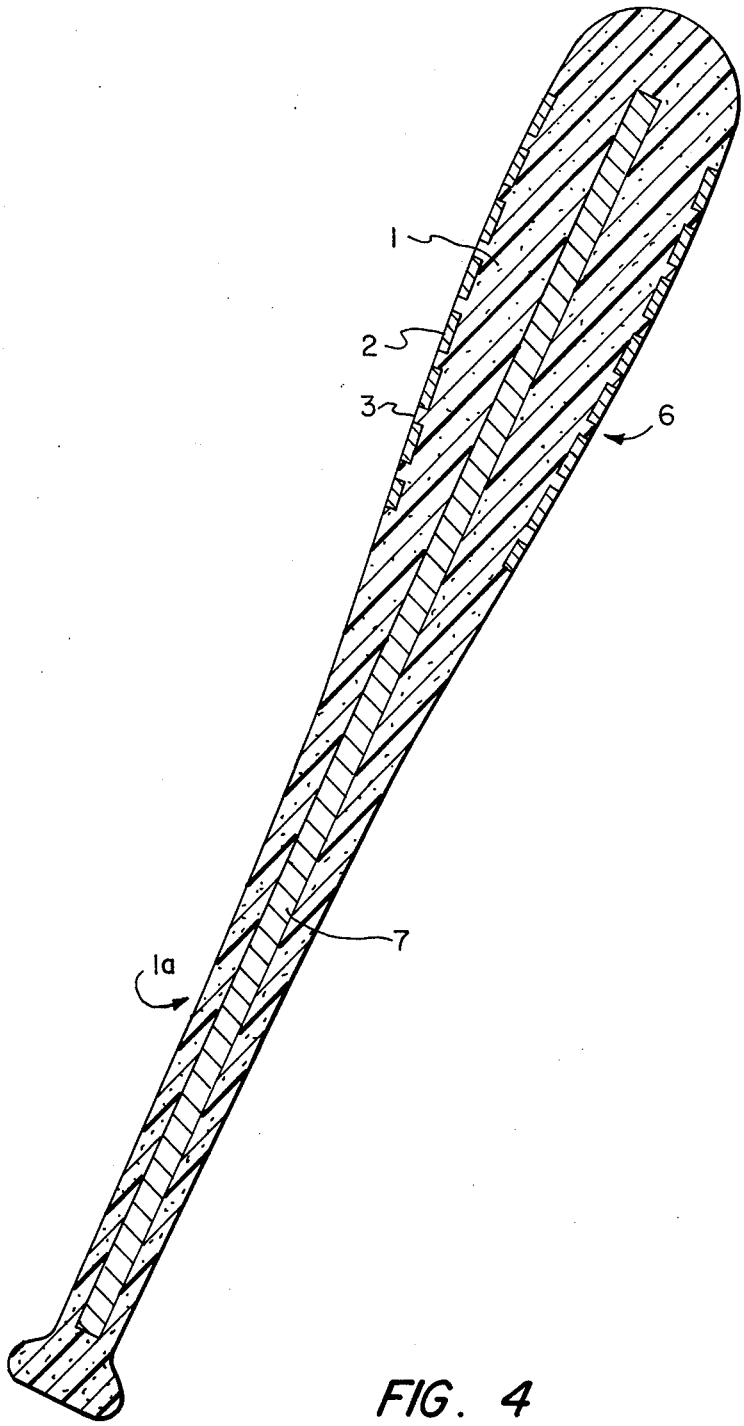
FIG. 4 is a sectional view showing a wooden core in the bat of the present invention.

Referring now to the drawings explaining the invention, a main member 1 has a barrel portion 6 connected to a handle or grip portion 1*a*. The main member 1 is made of urethane foam or other foamed resin. For the grip portion la of the bat, a balsam core 7 is especially suitable. The balsam core 7 may be also extended longitudinally from the grip portion 1*a* into the barrel portion 6 as shown by the broken lines in FIG. 4. A metal tube 2 of spring steel or duralumin is provided with many apertures 3 and, is only fixed to the barrel portion of the main member 1, and the junction of the surfaces over the metal tube 2 and the main member 1 is smoothed. The apertures 3 are filled with urethane foam. An outer layer 4 is formed by winding the main member 1 and the metal tube 2 with strings of glass fiber. This outer layer 4 may also be formed by a roving sheet, or otherwise, by covering the main member 1 and the metal tube 2 with material in the form of a sack or a stocking, using a knitted cloth of glass fiber. This forming process, may provide projections 4*a* resulting from the means of knitting at regular or irregular, or otherwise suitable intervals on the surface of the upper layer 4. Not only glass fiber but also general chemical fiber or other suitable tough fiber may be adopted as the material for the strings or the cloth which forms the outer layer 4. Finally, a synthetic resin paint is spread over the upper layer 4 and permeated into it, thus creating a paint layer 5.

Referring again to the drawings to explain the method of producing said bat, it comprises the main member 1 is spaced from synthetic resin such as urethane foam, wood or both by molding or by means of a mechanical cutting. Then a metal tube 2 of spring steel, duralumin or other metal with suitable quality for batting a ball is fixed to the barrel portion of the main member 1, and the metal tube is drilled to provide many apertures therein. These apertures are filled with urethane foam or other synthetic resin material thereby making it possible to smooth the surface over the main member and the metal tube. The main member, and the metal tube 2 are next covered with a glass fiber cloth 4 or other chemical fiber cloth or a winding to which wraps both of them in strings of these fibers, for instance, by means of forming a roving sheet. To form an outer layer over the fibers 4, paint and the like is spread over the surface of the outer layer 4 and the main member 1. Projections on the outer layer 4 may be provided at regular or at irregular intervals by means of a general forming step, for instance, by knitting. The accompanying drawing illustrate the bat produced by the process of the present invention. The main member 1 is made of urethane foam or other foamed resin by pressing the synthetic resin material into a mold. In this shaping process by pressing, a balsam core 7 is adopted for a grip portion 1*a* of the main member 1, and is fixed in the main member 1 by the synthetic resin material. The balsam core 7 may be further adopted as a core material which extends longitudinally through the grip portion 1*a* into the barrel portion 6. The metal tube 2 of spring steel or duralumin is provided with many apertures 3, and is arranged at the barrel portion 6 in the shaping process by pressing. The metal tube 2 is fixed to the main member 1 by foaming urethane foam material through the apertures 3 and smoothing the joint.

The apertures 3 are then filled with urethane foam. The main member 1 and the metal tube 2 are wound and covered with the strings of glass fiber to form the outer layer 4. The outer layer 4 is formed for instance by making a roving sheet or by covering closedly the main member 1 and the metal tube 2 with a stocking type sack knitted from said fibers. In this process, it is possible to knit projections 4*a* which will be positioned at regular or at suitable intervals on the surface of the outer layer 4. By spreading the synthetic resin paint over the outer layer 4 and the projections 4*a*, a paint layer 5 is formed and as the occasion demands, the paint may permeate into the outer layer 4, projections 4*a* and the main member 1. The projections 4*a* will still include projection lines. The use of this bat is the same as for general bats. According to the bat of the present invention, it having a metal tube of suitable quality for batting a ball at the barrel portion 6, the fight of a batted ball would be lengthened. Besides this, by having the outer layer 4 formed by covering the main member 1 and the metal tube 2 with the cloth of glass fiber or other chemical fiber or a winding of the strings of these fibers the shock caused by batting a ball which is transmitted to a batter through a bat is absorbed into the outer layer 4 and he is not or is only slightly numbed by the shock. This bat is furthermore tough enough as a bat used in baseball and when the projections are provided on the outer layer, it eliminates fouling and tipping. The producing method in the present invention is an effect to get a bat used in baseball being the following effects. The reason for placing the metal tube at the barrel portion of the bat is to satisfactorily lengthen the flight of a batted ball and the reason why the outer layer 4 is so formed is to absorb the shock caused by hitting the ball and to prevent it from being transmitted to a batter. When the projections are formed on the outer layer, they prevent the ball from sliding and, consequently, result in a bat which will refuse to cause fouling and tipping when a ball is hit.

I claim:

1. A bat used in baseball, said bat comprising:

a main member having a barrel portion for hitting a baseball and a grip portion joined to said barrel portion for holding the bat, said main member being formed from materials selected from the group consisting of urethane foam, wood, or a combination of urethane foam and wood;

a metal tubular portion having a plurality of openings therethrough fitted only around said barrel portion of said main member;

urethane foam foamed through the openings through said metal tubular portion joining said metal tubular portion to said barrel portion of said main member;

glass cloth surrounding said metal tubular portion and said main member; and a coating of synthetic resin paint over said glass cloth.

2. A bat as claimed in claim 1 wherein said main member is comprised of urethane foam and has a wooden core longitudinally through said grip portion.

3. A bat as claimed in claim 1 wherein said main member is comprised of urethane foam and has a wooden core longitudinally through both said grip portion and said barrel portion.

4. A bat as claimed in claim 1 wherein said glass cloth is strings of glass fiber wound around said metal tubular portion and said main member.

5. A bat as claimed in claim 1 wherein said glass cloth is a stocking of knitted glass fiber fitted around said metal tubular portion and said main member.

6. A bat as claimed in claim 1 wherein said metal tubular portion is comprised of duralumin.

* * * * *